US006656064B2

(12) United States Patent
Zielinski

(10) Patent No.: US 6,656,064 B2
(45) Date of Patent: Dec. 2, 2003

(54) HOCKEY STATION AND SLAT APPARATUS

(76) Inventor: Mark Zielinski, 2118 Colby Point Rd., McHenry, IL (US) 60050

( * ) Notice: Subject to any disclaimer, the term of this patent is extended or adjusted under 35 U.S.C. 154(b) by 0 days.

(21) Appl. No.: 09/990,226

(22) Filed: Nov. 21, 2001

(65) Prior Publication Data

US 2003/0096666 A1 May 22, 2003

(51) Int. Cl.[7] ..... A63B 69/00; A63B 63/00

(52) U.S. Cl. ..... 473/446; 473/478; 473/411; 273/127 R; 273/118 R

(58) Field of Search ..... 473/415, 422, 473/438, 446, 470, 469, 478, 476; 478/FOR 132, 103, 104; 273/118 R, 127 R, 336, 348, 338–340, 402

(56) References Cited

U.S. PATENT DOCUMENTS

| | | | | |
|---|---|---|---|---|
| 1,206,194 A | * | 11/1916 | Becker | 273/118 R |
| 2,006,497 A | * | 7/1935 | Couse | 273/118 R |
| 2,525,881 A | * | 10/1950 | Felter | 273/127 R |
| 2,685,140 A | | 8/1954 | Nedwick | |
| 3,255,115 A | | 6/1966 | Peterson | |
| 3,709,489 A | | 1/1973 | Holleran et al. | |
| 3,865,375 A | * | 2/1975 | Cosgrove | 473/411 |
| 4,147,347 A | * | 4/1979 | Angove | 273/127 B |
| 5,226,821 A | | 7/1993 | Murphy et al. | |
| 5,238,243 A | | 8/1993 | Grispi | |
| 5,484,147 A | | 1/1996 | Fagan | |
| 5,647,747 A | | 7/1997 | Macri et al. | |
| 5,669,833 A | | 9/1997 | Stone | |
| 5,895,330 A | | 4/1999 | Reilly, Jr. | |
| 6,059,673 A | | 5/2000 | Mason | |
| 6,099,420 A | | 8/2000 | Nandra | |
| 6,165,084 A | | 12/2000 | Cranston | |

* cited by examiner

*Primary Examiner*—Paul T. Sewell
*Assistant Examiner*—Mitra Aryanpour
(74) *Attorney, Agent, or Firm*—Michael I. Kroll

(57) ABSTRACT

The present invention 10 discloses a first embodiment having a straight line apparatus consisting of tubular channels 18 that pass through risers 20 that elevate the channels off the ground. The end risers 22 provide a port 24 on one distal end that allows the user to attach other succeeding lengths of channel 30 to the main structure via couplers 26 that are inserted into the end port 24. The second embodiment 34 provides a curved apparatus, consisting of main tubular channels 32 that pass through main risers 34 that elevate the channels 32 off the ground. The main end risers 42 of the main structure provide ports on one distal end to allow the user to attach other units, via main couplers 40, to expand the apparatus to a larger size. The side channels 36 and risers 38 can be removed and snapped together in a stacked fashion for easy storage and transportation of the device. Main end caps 44 are also provided and are attached to the main end riser port when additional stations are not in use.

12 Claims, 14 Drawing Sheets

HOCKEY STATION AND SLAT APPARATUS

BACKGROUND OF THE INVENTION

1. Field of the Invention

The present invention relates generally to hockey apparatus and more specifically to a hockey practice apparatus used to improve a players stick handling, speed, timing, eye and stick coordination, and stick to skate coordination by maneuvering a hockey puck in out and around the apparatus, forcing the user to lift their stick up and over the channels, pursuing control of the puck.

The hockey apparatus of the present invention consists of two types of design. The first design is a straight-line apparatus consisting of tubular channels that pass through risers that elevate the channels off the ground. The end risers provide a port on one distal end that allows the user to attach other lengths of apparatus to the main structure via couplers that are inserted into the end port. The second design provides a curved apparatus, consisting of tubular channels that pass through risers that elevate the channels off the ground. The end risers of the main structure provide ports on one distal end to allow the user to attach other units, via couplers, to expand the apparatus to a larger size. The main structure of the device is one piece. The side channels and risers can be removed and snapped together in a stacked fashion for easy storage and transportation of the device. End caps are also provided and are attached to the end riser port when additional stations are not in use.

2. Description of the Prior Art

There are other practice device designed for toning ones sports skills. Typical of these is U.S. Pat. No. 2,685,140 issued to Nedwick on Aug. 3, 1954.

Another patent was issued to Peterson on Jun. 7, 1966 as U.S. Pat. No. 3,255,115. Yet another U.S. Pat. No. 3,709,489 was issued to Holleran et al on Jan. 9, 1973 and still yet another was issued on Jul. 13, 1993 to Murphy et al. as U.S. Pat. No. 5,226,821.

Another patent was issued to Grispi on Aug. 24, 1993 as U.S. Pat. No. 5,238,243. Another patent was issued to Fagan on Jan. 16, 1996 as U.S. Pat. No. 5,484,147. Another patent was issued to Macri et al on Jul. 15, 1997 as U.S. Pat. No. 5,647,747. Another patent was issued to Stone on Sep. 23, 1997 as U.S. Pat. No. 5,669,833. Another patent was issued to Reilly, Jr. on Apr. 20, 1999 as U.S. Pat. No. 5,895,330.

Another patent was issued to Mason on May 9, 2000 as U.S. Pat. No. 6,059,673. Another patent was issued to Nandra on Aug. 8, 2000 as U.S. Pat. No. 6,099,420. Another patent was issued to Cranston on Dec. 26, 2000 as U.S. Pat. No. 6,165,084.

U.S. Pat. No. 2,685,140

Inventor: Zygmund Nedwick

Issued: Aug. 3, 1954

The present invention relates to runways, guide ways and the like for athletics and running practice, and particularly to what is termed a rib run or guide rib runway.

U.S. Pat. No. 3,255,115

Inventor: Eldon Peterson

Issued: Jun. 7, 1966

A leg muscle conditioning device which will permit one to step or run therethrough but will require the knees to be raised to an accentuated height in order to permit passage therethrough. The device is comprised of a rigid frame with a net suspended on the top thereof wherein the net can be selectively adjusted to maintain a predetermined degree of tightness.

U.S. Pat. No. 3,709,489

Inventor: Thomas Holleran et al.

Issued: Jan. 9, 1973

This easily assembled, low-cost, versatile apparatus for evaluating the hockey skills of individual players, particularly their shooting, passing and stick handling abilities, comprises a self-supporting, multi-sectioned upstanding wall structure defining, on a substantially flat surface, at least first, second and third adjacent substantially-rectilinear compartments. Two of the compartments have puck target means at one end and are open at the other end so as to provide a shooting position for the contestant, the puck target means comprising a vertically-disposed wall having a plurality of puck receiving apertures therethrough, the size and location of the apertures differing in the respective compartments. The third substantially-larger compartment has a plurality of upstanding separator devices positionable on the flat surface therein and in spaced relation from each other and from the wall structure so as to define a continuous serpentine path for the contestant to follow. In addition to testing ice, roller and field hockey skills, the apparatus may be used for hockey practice and as a competitive game.

U.S. Pat. No. 5,226,821

Inventor: John Murphy et al.

Issued: Jan. 13, 1993

A hockey training device includes a base having a first end and a second end, a side having a bottom end and a top end, a telescoping connector, and at least one locating surface mounted on the hockey training device to support the hockey training device above a playing surface. The bottom end of the side is pivotally connected to the first end of the base and the telescoping connector is pivotally connected to the second end of the base and the top end of the side, such that the base, side and telescoping connector form a triangle.

U.S. Pat. No. 5,238,243

Inventor: Richard Grispi

Issued: Aug. 24, 1993

A hockey target includes a vertical board having a plurality of openings. The openings are directed through the board into a receiving net cage rearwardly of the vertical board. The invention is further arranged to optionally include counter structure, whereupon projection of a target puck through one of said openings effect actuation of counter mechanism structure mounted to a side portion of the vertical board.

U.S. Pat. No. 5,484,147

Inventor: Kenneth Fagan

Issued: Jan. 16, 1996

A hockey practice apparatus including a plurality of interconnected arcuate shaped segments forming a substantially half circle section, and at least one tangential segment connected to one end of the half circle section. Projecting a hockey puck at an angle against the tangential section causes it to follow around the half circle section and exit back into the playing area. For more versatile practice, an eccentrically mounted roller at the exit end of the half circle section serves to return the puck to the playing area in various directions at random.

U.S. Pat. No. 5,647,747

Vincent Macri et al.

Issued: Jul. 15, 1997

The invention comprises one or more electromechanical robots in human form designed to resemble hockey player (s). The robots are suspended from a movable overhead track and powered by motorized cars along a variety of courses, all of which causes the robots to move at the speed(s) and follow the skating pathways used in hockey plays and maneuvers. The elevation, speed and pathways followed by the robots are selected from a computer menu. The robots may be used for instructing and training skaters in the skills, maneuvers and plays essential to the sport of ice (and roller) hockey. The robots are designed to provide a teaching/learning tool and to be used in conditions which realistically resemble those that skaters/players encounter in real hockey games. Robots are equipped with sensor chips which, when impacted by the skater, will provide measurable data regarding the skater's performance during training sessions. Feedback will also be provided via video recordings of the training sessions and by other means, such as digitized images of the skater(s) and robot(s). The overhead tracks from which the robots are suspended may be raised to a position far above the ice surface when robots are not in use, so as to provide a clear rink to be used for other purposes.

U.S. Pat. No. 5,669,833

Inventor: David Stone

Issued: Sep. 23, 1997

A system for training an athlete in kicking and dribbling a soccer ball employs a flexible cord that defines a dribble path along the playing surface. The flexible cord is maintained at a predetermined height above the playing surface by a plurality of stanchions arranged in spaced relation, which may be in the form of hollow cones similar to those employed in traffic control. The stanchions may be hollow, and access provided to the interior thereof, for depositing a weighting material, such as sand or water, to improve the stability of the training system during a training session. In accordance with a method aspect, a predetermined dribble path is defined by the flexible cord which is maintained at the predetermined height above the playing surface, sufficient to permit the soccer ball to be dribbled thereunder by the plurality of stanchions. The athlete jumps over the flexible element to gain control over the ball.

U.S. Pat. No. 5,895,330

Inventor: Francis Reilly Jr.

Issued: Apr. 20, 1999

A modified sports goal is adapted for training a sports player to direct objects into preferred target areas. A modified goalpost frame is formed in the shape of a preferred target area of a standard sports goal. A net is coupled to the goalpost frame. The goalpost and net capture objects, such as hockey pucks, directed into the preferred target area, and allow misdirected objects which otherwise would have been captured by the standard sports goal to pass thereby. In this manner, a participant is rewarded with the feeling of achieving a goal only if the object enters the target areas. Otherwise, the object passes by the goal. This goal reduces the need for goaltenders during practice sessions, mitigating the possibility of goaltender injury and improving the shooter's ability to develop skills.

U.S. Pat. No. 6,059,673

Inventor: Donald Mason

Issued: May 9, 2000

A goalie training system for providing a realistic training system that accommodates a goalie and a plurality of shooters at different angles. The inventive device includes a goalie zone and a plurality of shooting lanes extending from the goalie zone at various angles. The goalie zone is comprised of a center member, a pair of side members adjacent the center member, a center surface above the center member, and a pair of side surfaces above the side members. The center surface, the side surfaces and the lane surface are comprised of a synthetic ice material that allows conventional ice skates to be utilized. The plurality of shooting lanes is comprised of at least one lane member and at least one lane surface positioned above the lane member. A goal is positioned behind the goalie zone for simulating a realistic hockey rink. At least one shooter is able to utilize the shooting lane for shooting pucks at the goal which the goalie attempts to deflect within the goalie zone.

U.S. Pat. No. 6,099,420

Inventor: Mukhtar Nandra

Issued: Aug. 8, 2000

A portable hockey practice system for increasing a hockey player's skill in shooting and catching a hockey puck along with developing quicker and better reflexes. The inventive device preferably includes three track sections each having a slot, a plurality of connecting members that connect the three track sections with conventional fasteners, a first end plate and a second end plate at opposing ends of the connected track sections, a first spring and a second spring attached to opposing end plates, and a puck attached to spacer slidably positioned within the slot of the connected track sections. The user engages the puck with a conventional hockey stick driving the puck towards the first spring. The first spring rebounds the puck towards the user. The user has the option of either catching the puck or letting the puck pass through where after it engages the second spring that rebounds the puck back to the user to stop with their back hand motion. The user can adjust the velocity of the puck rebounding from the first spring by adjusting the adjusting bolt that retains the first spring semi-compressed.

U.S. Pat. No. 6,165,084

Inventor: Rene Cranston

Issued: Dec. 26, 2000

A hockey training device comprising a frame with skate-like and hockey stick-like members attached thereto, simulating an opposing player. This training device is intended to assist the novice hockey player in developing the skills associated with maneuvering the hockey puck around and/or through an opponent, and forces the novice to concentrate on the triangle presented by the skates and hockey stick of the opponent. The device consists of a frame supporting two downwardly disposed legs having skate-like elements attached, and a third leg having a stick-like element attached. The skate-like elements and stick-like elements have coplanar lower edges so that the entire device may be placed on the ice, resting on these edges. The frame may be weighted, and drag-inducing spikes may be incorporated into the skate-like elements to affect the motion of the device on the ice.

SUMMARY OF THE PRESENT INVENTION

The present invention discloses a first embodiment having a straight line apparatus consisting of tubular channels that pass through risers that elevate the channels off the ground. The end risers provide a port on one distal end that allows the user to attach other lengths of succeeding channel to the main structure via couplers that are inserted into the end port. The second embodiment provides a curved apparatus, consisting of main tubular channels that pass through main risers that elevate the channels off the ground. The main end risers of the main structure provide main ports on one distal end to allow the user to attach other units, via main couplers, to expand the apparatus to a larger size. The removable side channels and risers can be removed and snapped together in a stacked fashion for easy storage and transportation of the device. Main end caps are also provided and are attached to the main end riser port when additional stations are not in use.

A primary object of the present invention is to provide a hockey practice apparatus to assist in improving a players stick coordination, speed, timing, eye to stick coordination and stick to skate coordination.

Another object of the present invention is to provide a hockey practice apparatus that makes the user lift their stick above and over the apparatus to gain control of the hockey puck.

Yet another object of the present invention is to provide a hockey practice apparatus that can be used on any surface.

Still yet another object of the present invention is to provide a hockey practice apparatus that is light in weight, portable and storage able.

Yet another object of the present invention is to provide a hockey practice apparatus consisting of tubular channels, supported by risers that elevate the channels off the ground.

Yet another object of the present invention is to provide a hockey practice apparatus consisting of end channels that at one distal end contain adapter ports for the attachment of other apparatus.

Yet another object of the present invention is to provide a hockey practice apparatus that consists of two styles, a straight line apparatus and a curve line apparatus.

Additional objects of the present invention will appear as the description proceeds.

The present invention overcomes the shortcomings of the prior art by providing a hockey practice apparatus to assist in improving a players stick coordination, speed, timing, eye to stick coordination and stick to skate coordination. Also makes the user lift their stick above and over the apparatus to gain control of the hockey puck. Provides a hockey practice apparatus that can be used on any surface, is light in weight, portable and storage able, consists of tubular channels, supported by risers that elevate the channels off the ground.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim.

LIST OF REFERENCE NUMERALS

Figure 1:
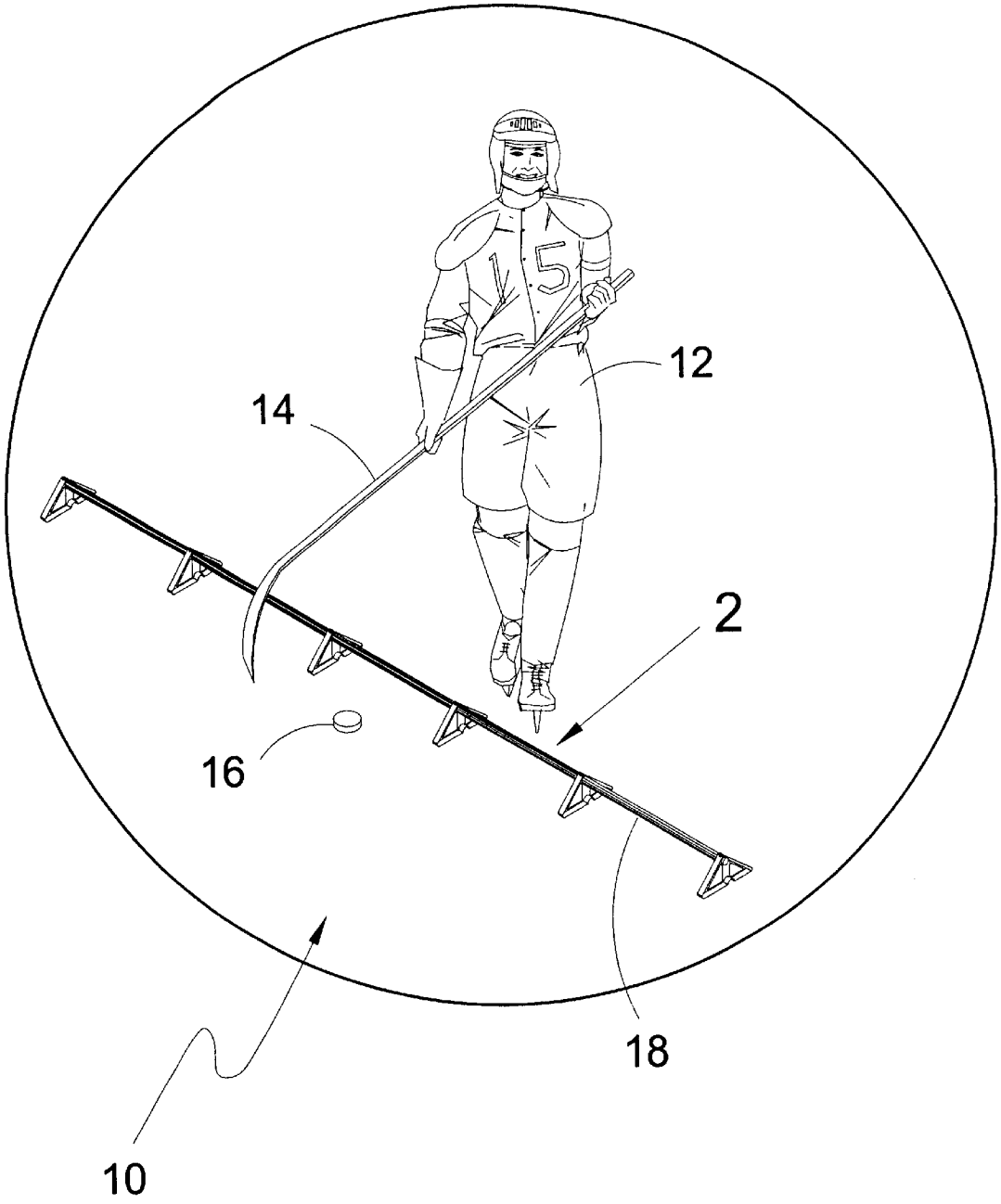
FIG. 1 is an illustrative view of the present invention in use.

With regard to reference numerals used, the following numbering is used throughout the drawings.

10 present invention
12 player
14 stick
16 puck
18 straight channel
20 riser
21 aperture
22 end riser
24 port
26 coupler
28 end cap
30 succeeding straight channel
32 main channel
34 main riser
36 removable channel
38 removable riser
40 main coupler
42 main end riser

44 main end cap

46 point of connection

48 recess

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention, a hockey handling slat and stations device, is designed to increase a player's 12 stick 14 handling, speed, timing, eye and stick coordination and stick to skate coordination by maneuvering the hockey puck 16 in and out and around the apparatus, forcing the user 12 to lift their stick 14 up and over the channel 18.

Figure 2:
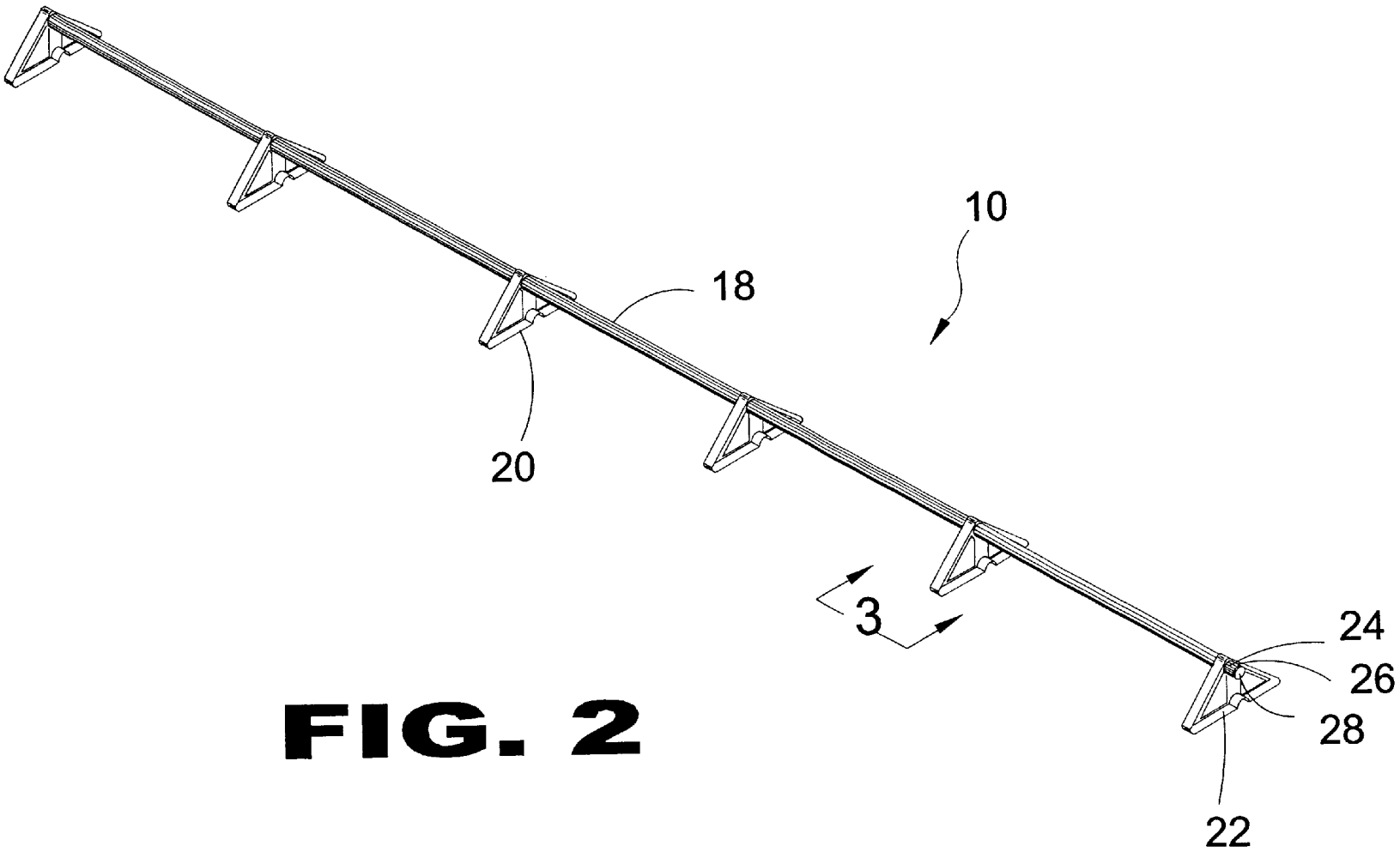
FIG. 2 is a perspective view of the present invention.

Turning to FIG. 2, shown therein is a perspective view of the present invention 10. The hockey apparatus of the present invention consists of an elongated, straight, round, tubular channel 18 supported by a plurality of triangular risers 20 that elevate the channels 18 off the ground surface. The main channel 18 is a one-piece structure, allowing for additional lengths to be attached to the ends thereof by using connector elements being a coupler 26 and port 24. Also shown is the end cap 28.

Figure 3:
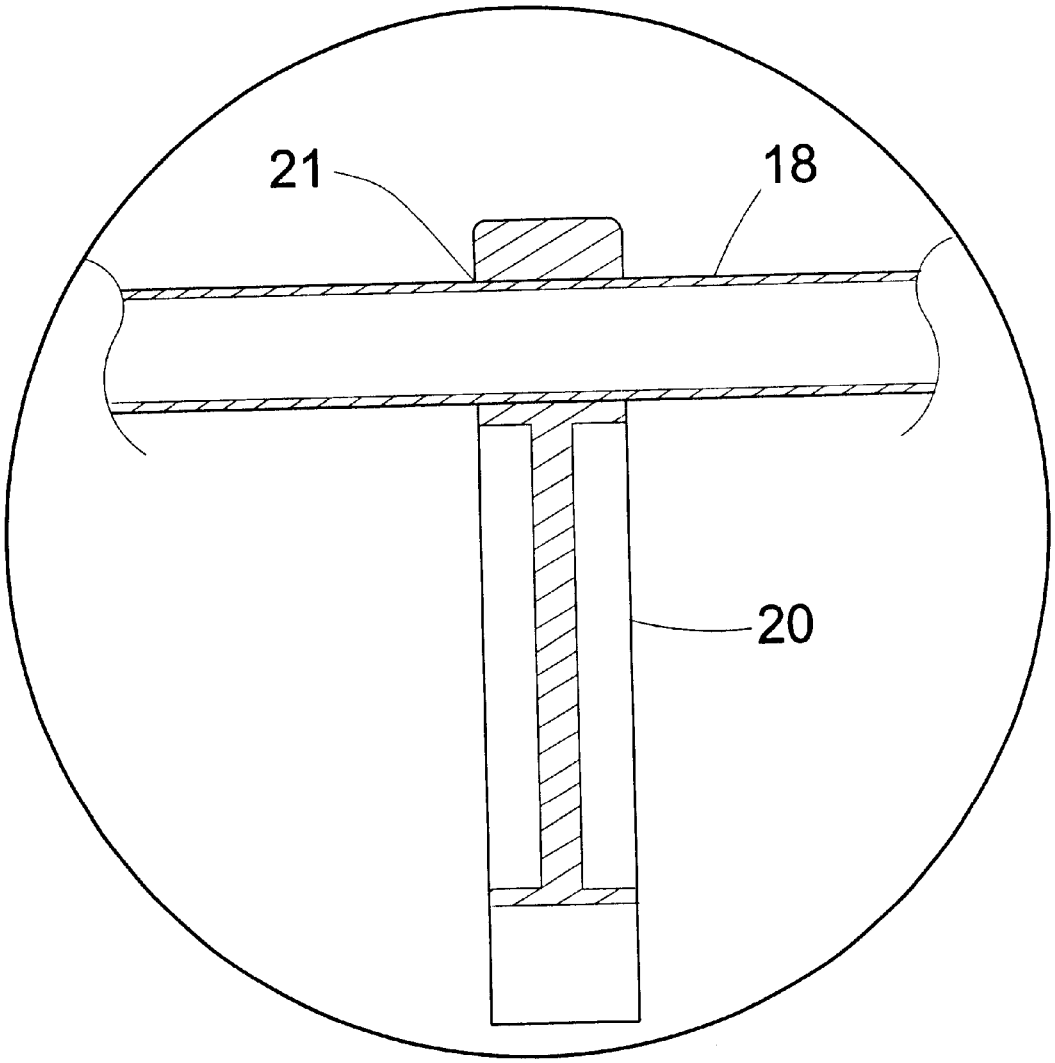
FIG. 3 is a cross sectional view of the present invention.

Turning to FIG. 3, shown therein is a cross sectional view of the present invention. The tubular channels 18 run through an aperture 21 disposed at the apex of the risers 20 to the end riser where it is constricted half way through. This allows a coupler with an adapter port, located on the other distal end of the riser to accept additional lengths of channel.

Figure 4:
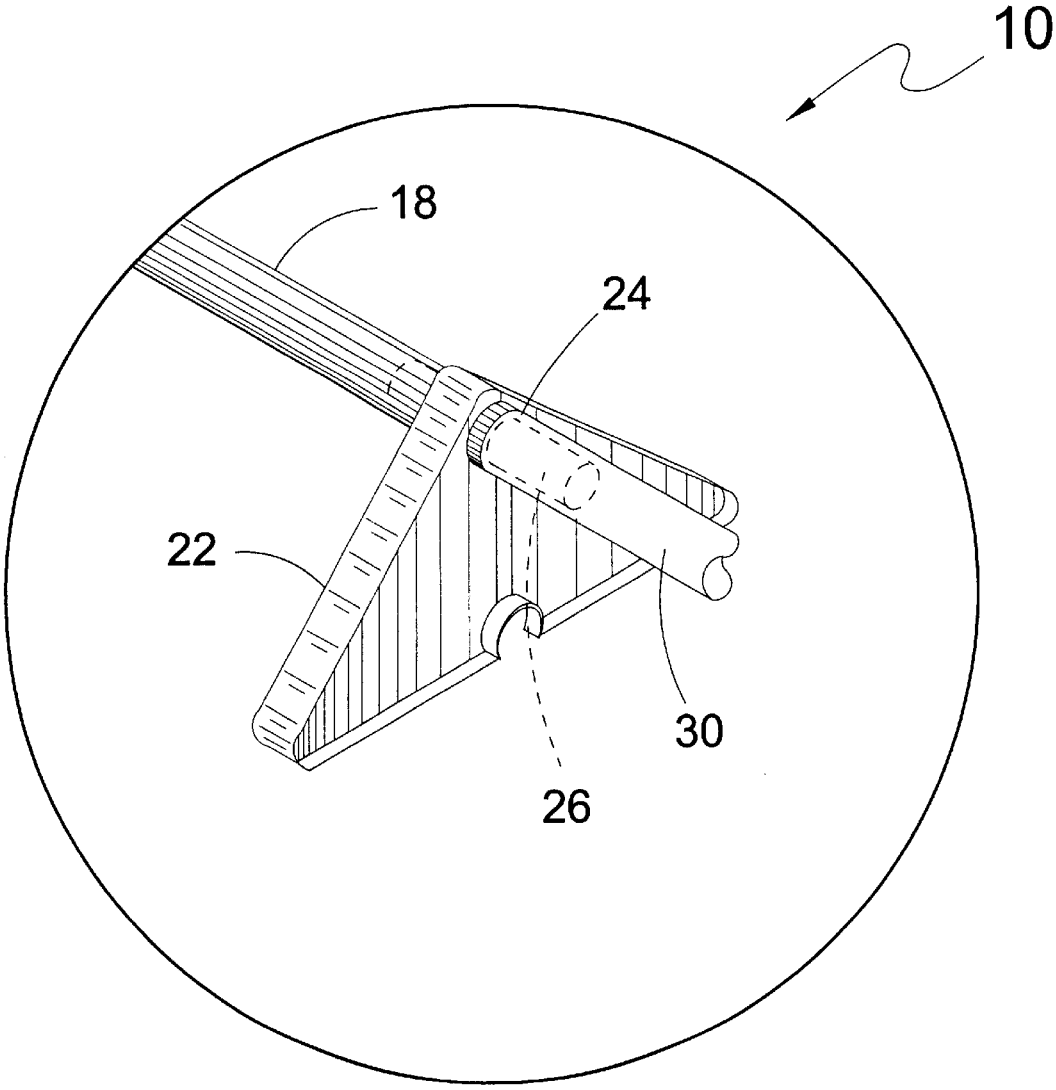
FIG. 4 is a detail view of the present invention.

Turning to FIG. 4, shown therein is a detailed view of the present invention 10. The end channel riser 22 of the present invention allows for other succeeding lengths of channel 30 to be added to channel 18 and supports the main channel and raises it above the ground. Also shown are the coupler 26 and port 24.

Figure 5:
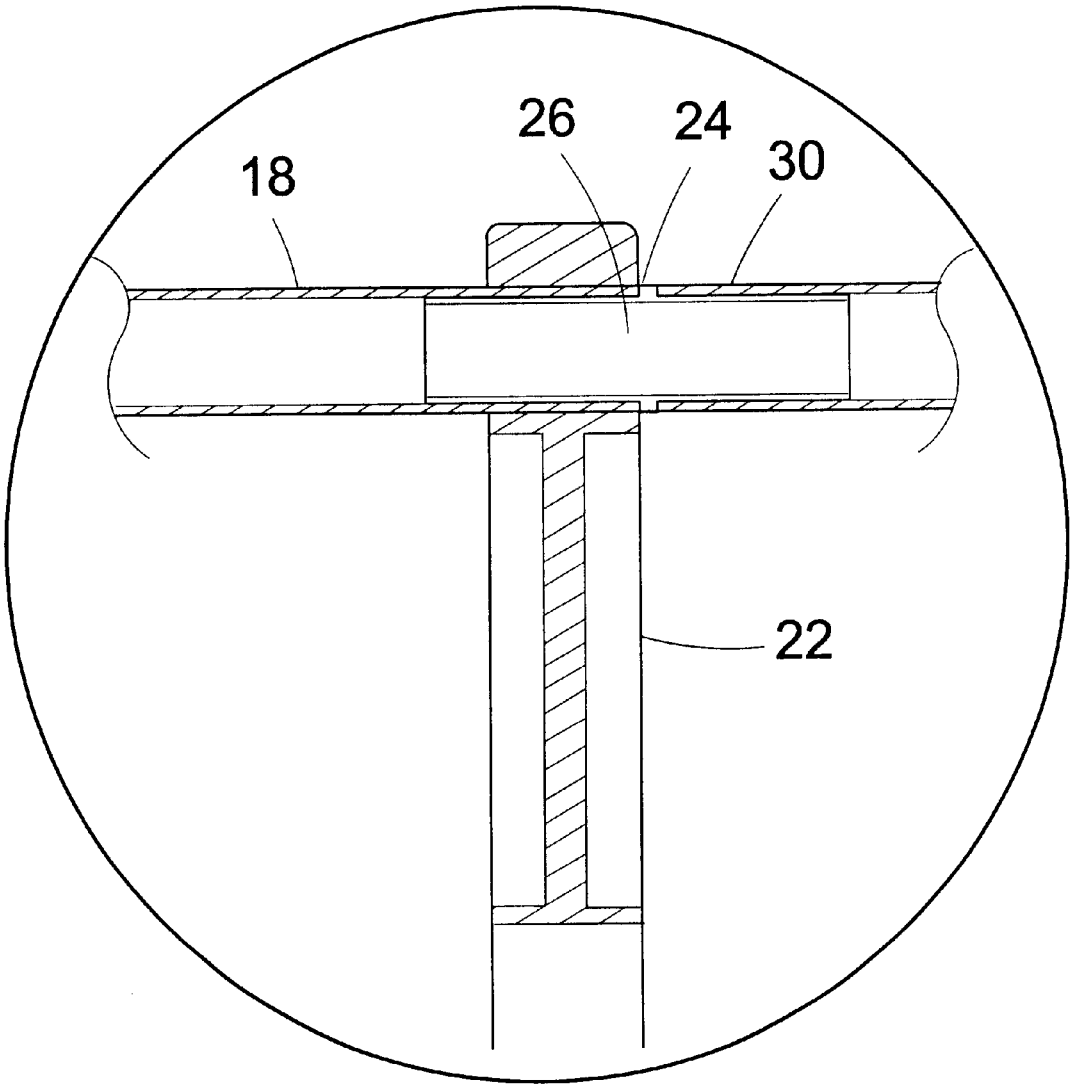
FIG. 5 is a cross sectional view of the present invention.

Turning to FIG. 5, shown therein is a cross sectional view of the present invention. The tubular channels 18 run through the channel risers to the end riser 22 and is restricted half way through. This allows an adapter port 24 located on the other distal end of the riser to accept a coupler 26 and additional lengths of channel 30. Coupler 26 provides a male member for insertion into an end of channel 18 and 30 to thereby join them together.

Figure 6:
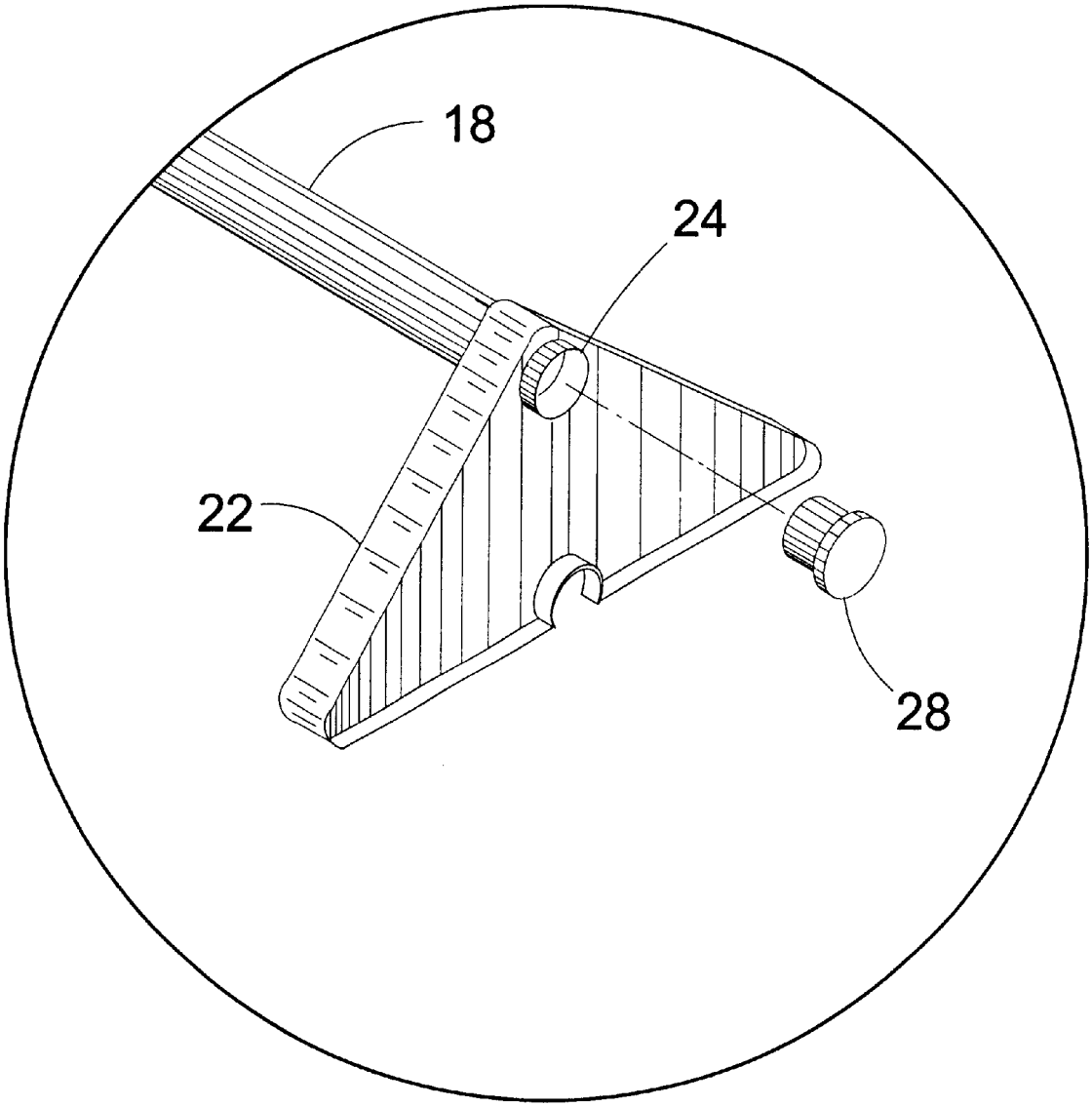
FIG. 6 is a detail view of the present invention.

Turning to FIG. 6, shown therein is a detail view of the present invention. The end channel riser 22 of the present invention allows for other lengths of channel to be added. It also supports the main channel 18 and raises it above the ground. The end port 24 allows for the insertion of an end cap 28 when additional lengths of channel are not used.

Figure 7:
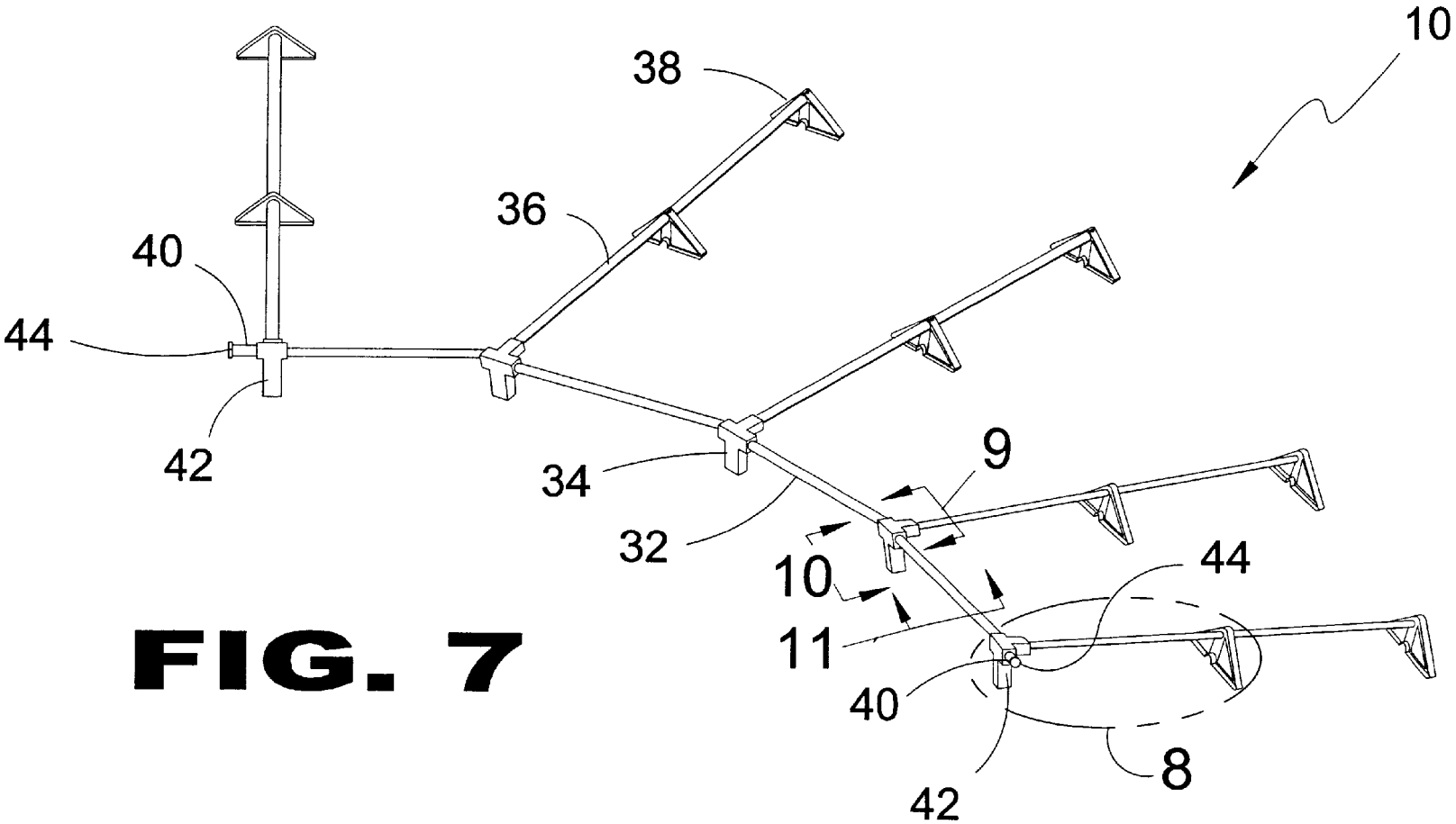
FIG. 7 is a perspective view of the curved station device of the present invention.

Turning to FIG. 7, shown therein is a perspective view of the curved station embodiment of the present invention 10. The main channel 32 and main risers 34 are one portion being the main portion of the structure. The removable channels 36 and removable risers 38 detach from the main structure for easy storage and transportation of the apparatus. Also shown are the main coupler 40, main end riser 42, and main end cap 44 which are similar in structure and function as previously disclosed hereinbefore.

Figure 8:
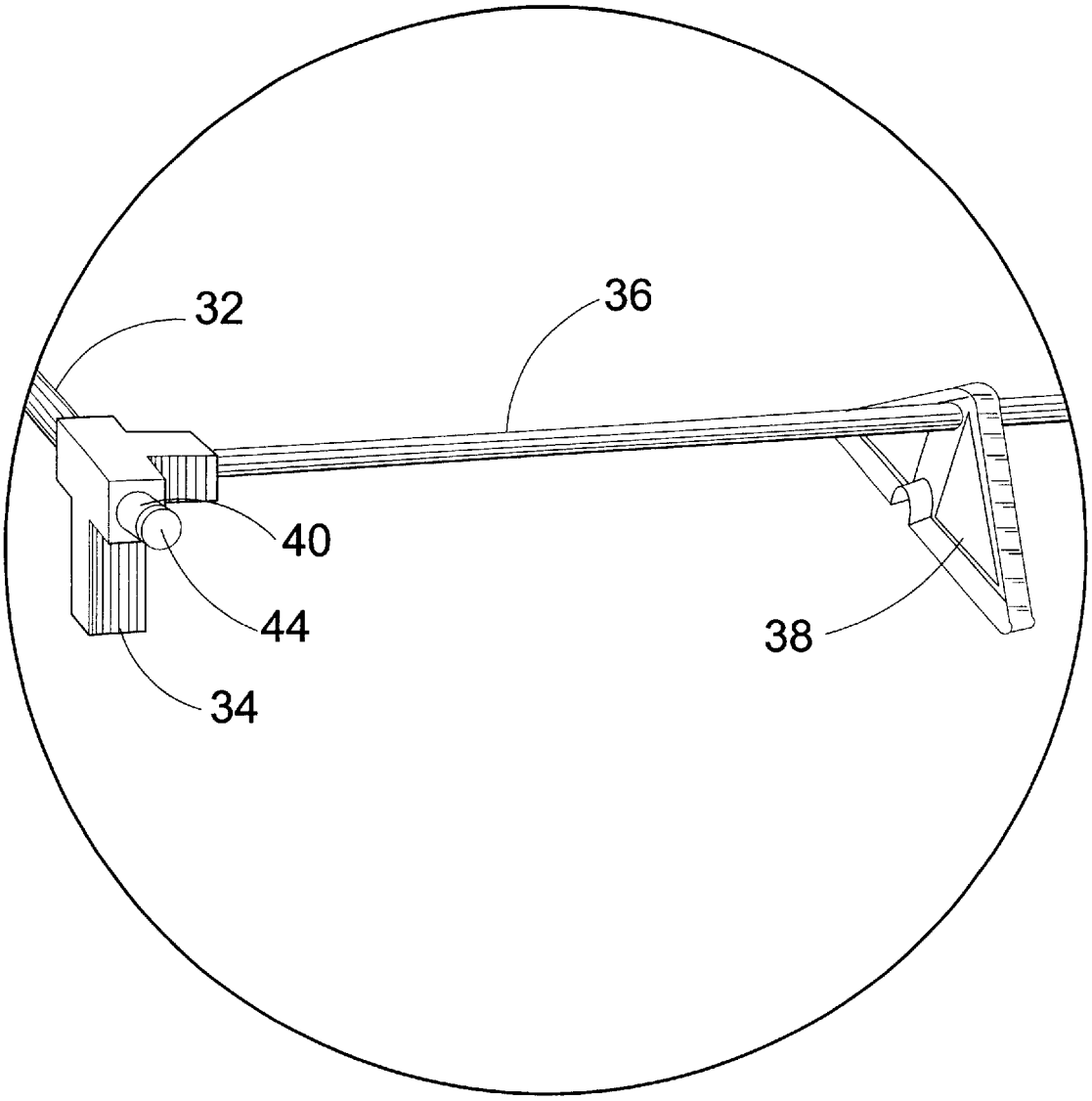
FIG. 8 is a detail view of the present invention.

Turning to FIG. 8, shown therein is a detail view of the present invention. The main end riser 34 of the present invention is equipped with end ports to allow additional stations to be attached. The main channel 32 and risers are one portion of the structure and the removable channels 36 and risers 38 are a second portion of the structure which can be removed for storage and transportation. Also shown are the main coupler 40 and end cap 44.

Figure 9:
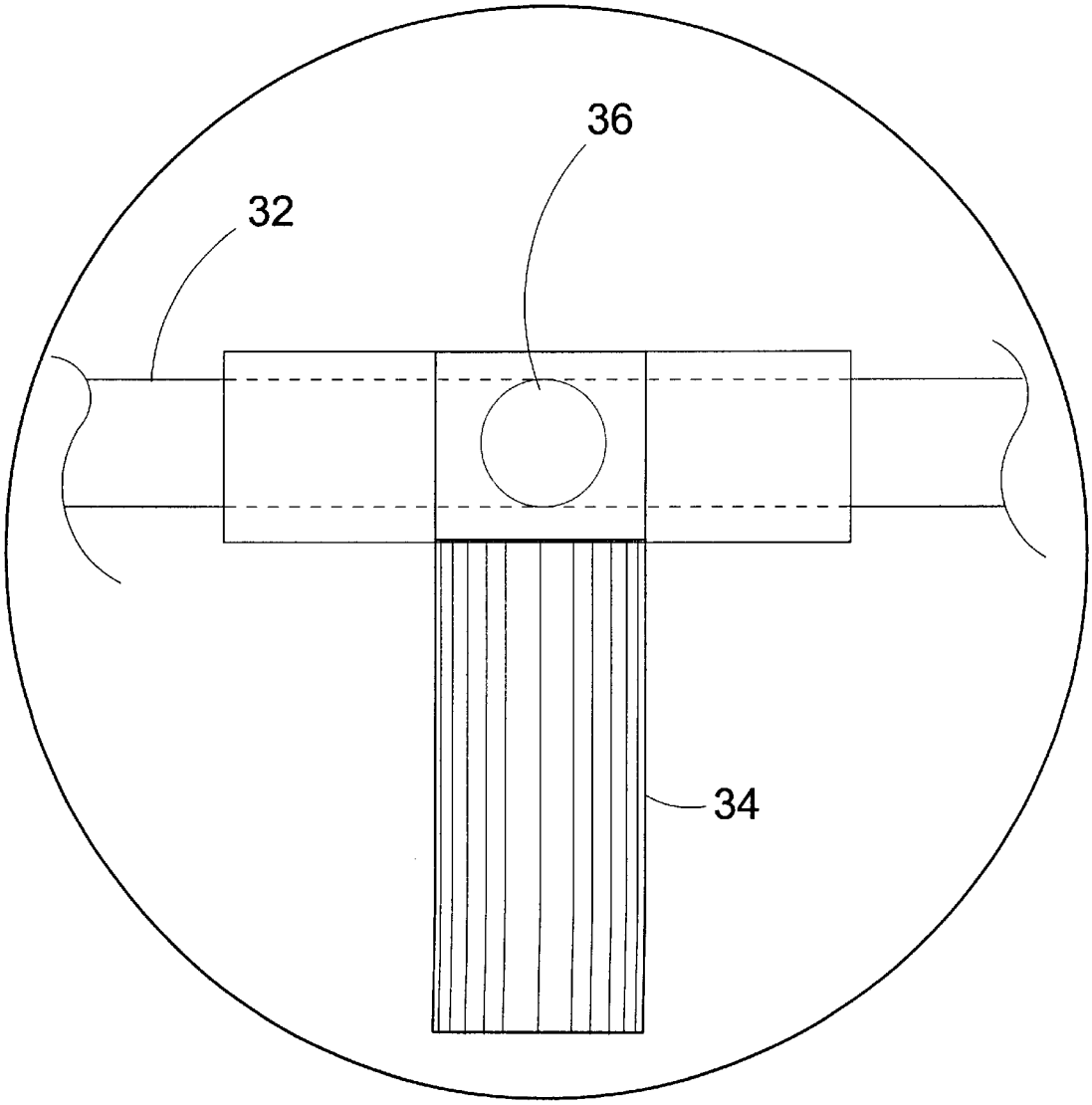
FIG. 9 is a sectional view of the present invention.

Turning to FIG. 9, shown therein is a sectional view of the present invention. Shown is the main riser 34 of the hockey station of the present invention with the main channel 32 passing through it and the removable channel 36 attaching thereto. The main riser 34 is a 3-way riser having a pair of apertures disposed about 180 degrees apart for receiving the main channel 32 and an aperture about 90 degrees apart from the first aperture for receiving the removable channel 36.

Figure 10:
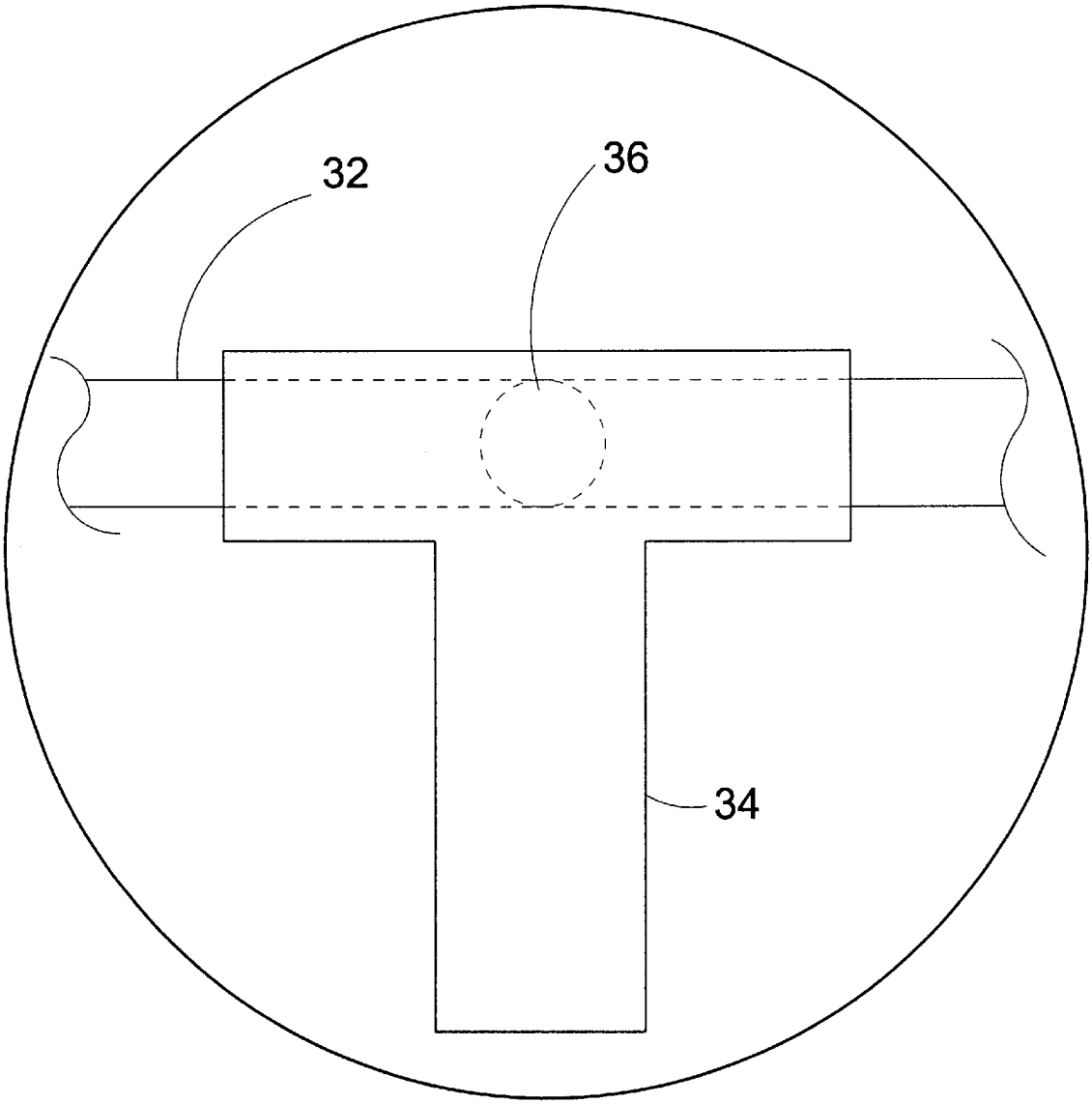
FIG. 10 is a sectional view of the present invention.
Figure 11:
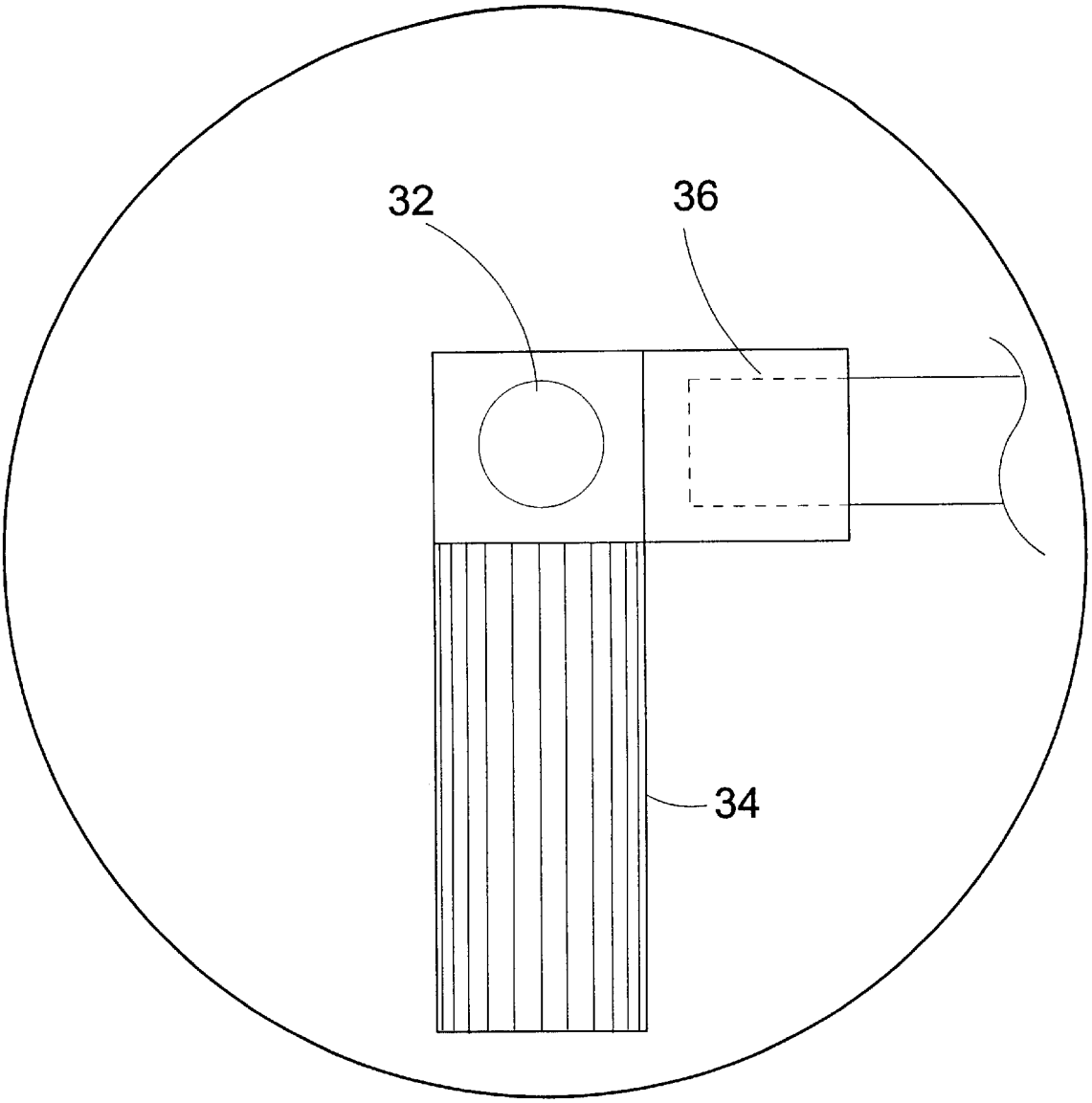
FIG. 11 is a sectional view of the present invention.

Turning to FIG. 10, shown therein is a sectional view of the present invention. Shown above, the main riser 34 with the main channel 32 passing through the riser and the removable channel 36 on the opposite side thereof Turning to FIG. 11, shown therein is a sectional view of the present invention. Shown above are the main riser 34 with the main channel 32 facing and the removable channel 36 to the side.

Figure 12:
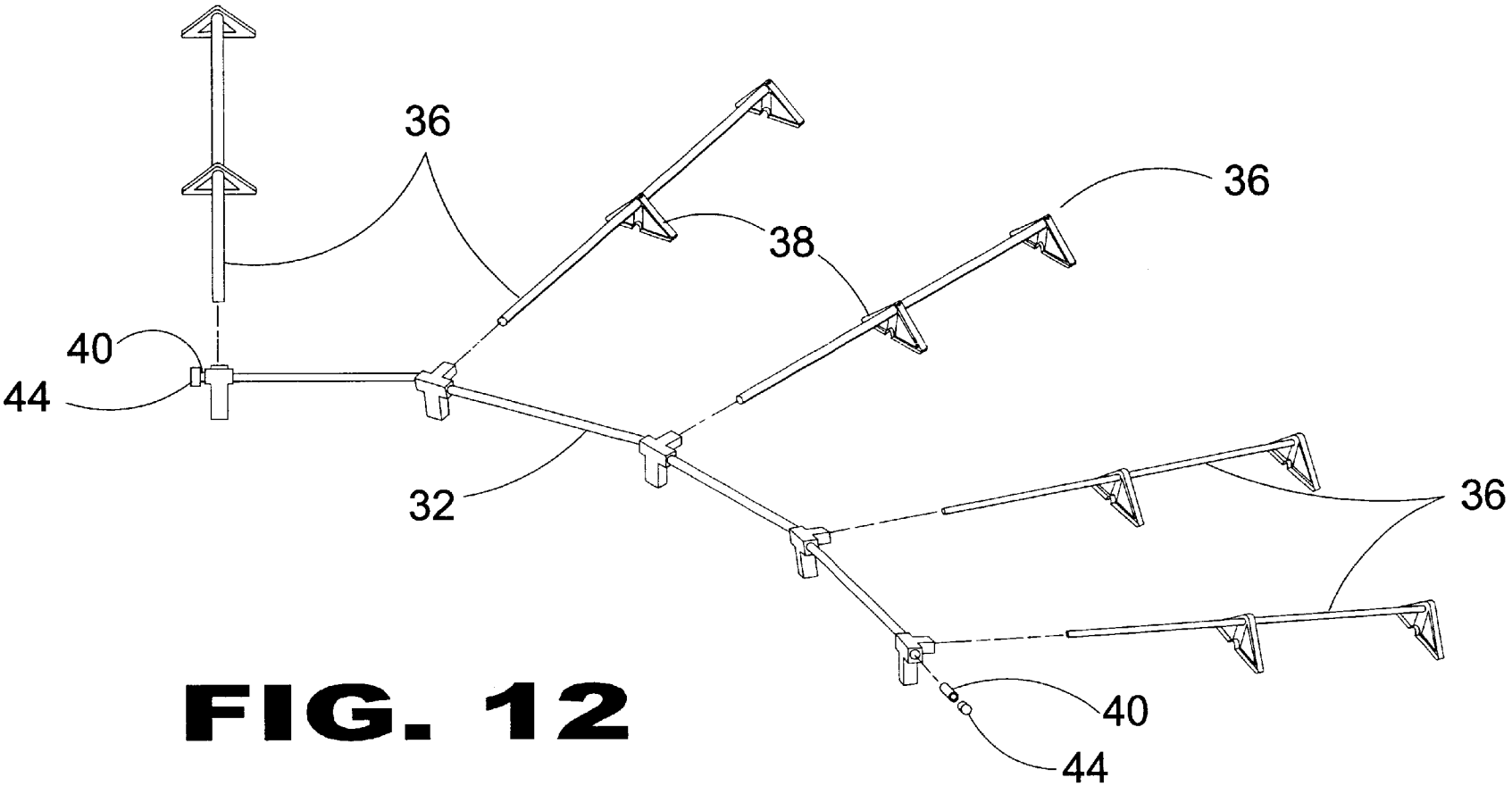
FIG. 12 is a perspective view of the curved line device of the present invention.

Turning to FIG. 12, shown therein is a perspective view of the curved line embodiment of the present invention 10 in use. Shown are the removal of the channels 36 and attaching risers 38 from the main structure of main channel 32. This provides easy storage and maneuverability of the device 10. Also shown are main coupler 40 and main end cap 44.

Figure 13:
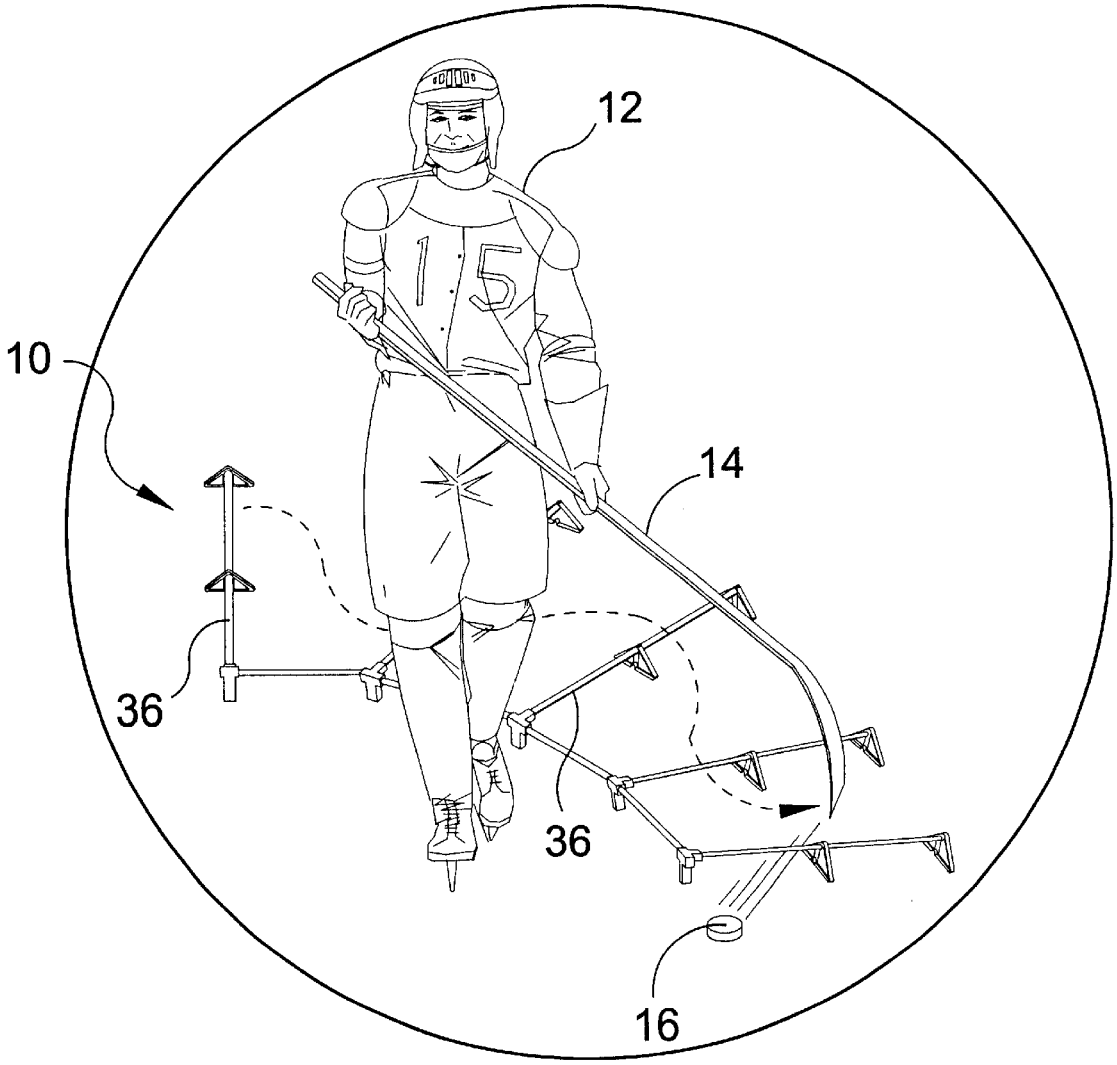
FIG. 13 is an illustrative view of the present invention.

Turning to FIG. 13, shown therein is an illustrative view of the curved embodiment of the present invention 10 in use. The hockey practice apparatus allows the user 12 to increase their skills in stick 14 handling, speed, timing and all around playing coordination by maneuvering the hockey puck 16 in and out and around the present invention 10, forcing the user 12 to lift their stick 14 up and over the channels 36.

Figure 14:
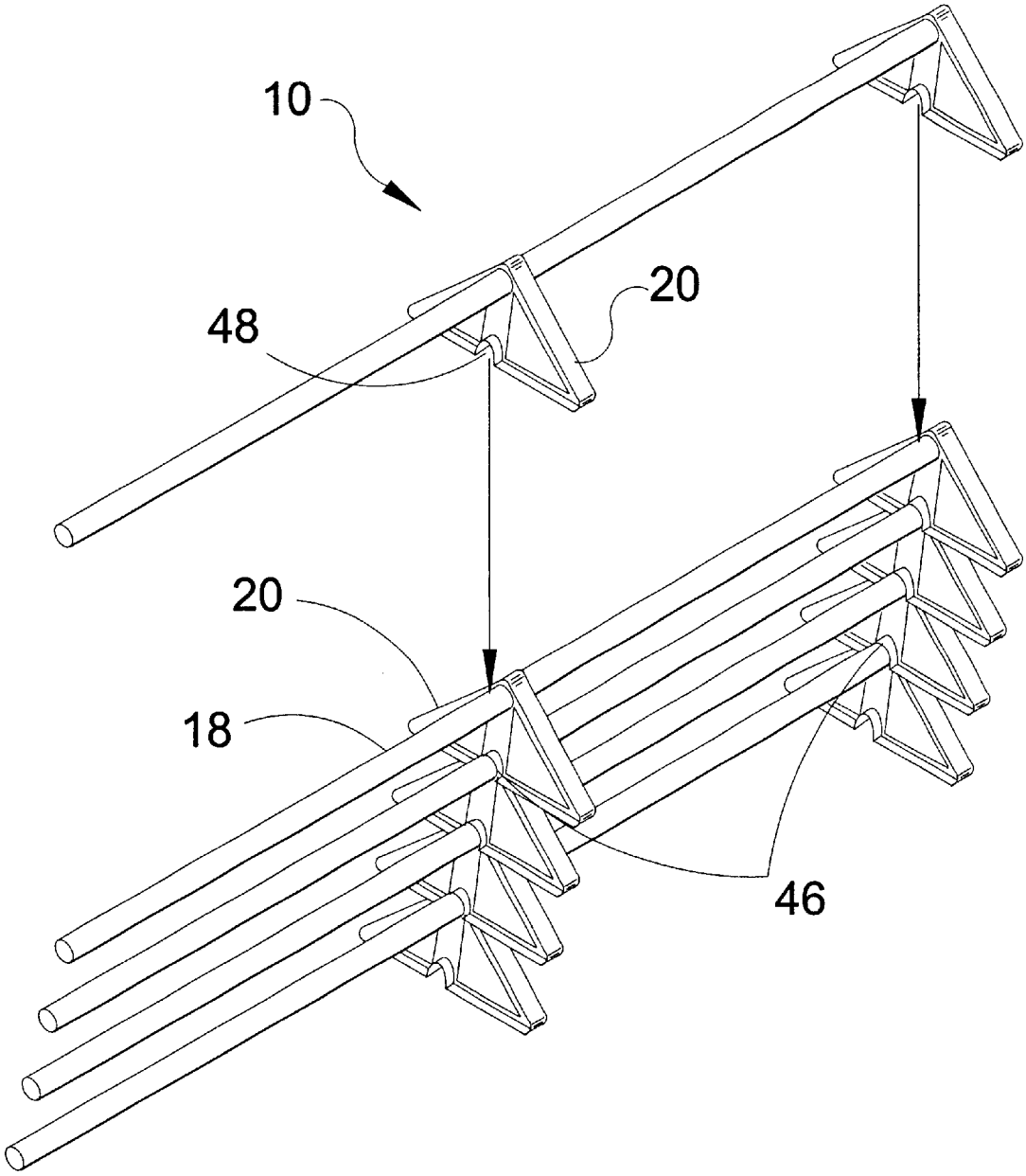
FIG. 14 is an illustrative view of the present invention.

Turning to FIG. 14, shown therein is an illustrative view of the present invention 10. The hockey practice apparatus allows the user to snap together the channels 18 into the risers 20 at 46 for easy storage. A recess 48 on the base of the rectangular riser 20 receives the channel 18 therein for stacking.

I claim:

1. In apparatus for a hockey practice device for use by a hockey player using a stick and a puck, comprising:

a) a first straight channel member, said first channel member being tubular, said first channel member having a first end and a second end;

b) a plurality of triangular risers disposed along said first channel member in a spaced apart relationship wherein the base of said risers support said first channel member for disposition above a support surface to permit a puck to pass underneath the first channel member;

c) wherein said risers have an aperture at the apex thereof, said aperture sized to receive said first channel member;

d) a pair of end caps disposed on said first and second ends of said first channel member; and e) the base of said risers having a recess therein, said recess sized to receive said first channel member to permit a plurality of said first channel members to be stacked on top of each other.

2. The apparatus of claim 1, further comprising a second straight channel member and a means of connecting said second straight channel member to an end of said first straight channel member whereby the apparatus can be lengthened, said second straight channel member having a first end and a second end.

3. The apparatus of claim 2, wherein said means of connecting said second straight channel member to said first straight channel member comprises:

a) said second end of said first straight channel member having a first port therein;

b) said first end of said second straight channel member having a second port therein; and, c) a coupler member for insertion into said first port and said second port to permit said ends of said first and second channel members to be joined together.

4. An apparatus for a hockey practice device for use by a hockey player using a stick and puck, comprising:

a) a plurality of main channel members, said main channel members being tubular, said main channel members each having a first end and a second end;

b) a plurality of 3-way risers disposed on the ends of said main channel members to permit disposition of said main channel members above a support surface, wherein said 3-way risers connect said first and second ends of each succeeding main channel member;

c) wherein said 3-way risers have a first, a second and a third aperture therein, said first and second aperture sized to receive said first and second ends of each succeeding main channel member;

d) a plurality of removable channel members said removable channel members being tubular, said removable channel members having a first end and a second end;

e) a plurality of triangular risers disposed along said removable channel member in a spaced apart relationship wherein the base of said risers supports said removable channel member for disposition above a support surface to permit a puck to pass underneath the removable channel member;

f) wherein said risers have an aperture at the apex thereof, said aperture sized to receive said removable channel member; and, g) wherein said third aperture of said 3-way riser is sized to receive said first end of said removable channel member.

5. The apparatus of claim 4, further comprising a main end cap being disposed on said second aperture of said 3-way riser in place of a succeeding main channel member.

6. The apparatus of claim 5, further comprising a main end cap being disposed on said first aperture of said 3-way riser in place of a succeeding main channel member.

7. The apparatus of claim 6, further comprising a main coupler being disposed in said first and second aperture of said 3-way riser, wherein said coupler is a tubular member for insertion into said first and second aperture of said 3-way riser and said ends of said main channel member to lengthen the main channel member of the apparatus.

8. The apparatus of claim 7, wherein said plurality of main channel members are curved.

9. The apparatus of claim 8, wherein said plurality of removable channel members are straight.

10. The apparatus of claim 9, wherein the base of said plurality of triangular risers have a recess therein, said recess being sized to receive said removable channel member to permit said removable channel members to be stacked on top of each other.

11. The apparatus of claim 10, wherein said first and said second apertures of said 3-way riser are disposed about 180 degrees apart from each other.

12. The apparatus of claim 11, wherein said first and said third apertures of said 3-way riser are disposed about 90 degrees apart from each other.

* * * * *